US012345498B1

(12) United States Patent
Hsieh

(10) Patent No.: US 12,345,498 B1
(45) Date of Patent: Jul. 1, 2025

(54) GRENADE DEVICE OF A TOY GUN WITH AN ADJUSTABLE FIRING MUZZLE AND AN ADJUSTING METHOD THEREOF

(71) Applicant: KRISS INDUSTRIES ASIA LTD., New Taipei (TW)

(72) Inventor: Kai-Hung Hsieh, New Taipei (TW)

(73) Assignee: KRISS INDUSTRIES ASIA LTD., New Taipei (TW)

( * ) Notice: Subject to any disclaimer, the term of this patent is extended or adjusted under 35 U.S.C. 154(b) by 0 days.

(21) Appl. No.: 18/441,023

(22) Filed: Feb. 14, 2024

(30) Foreign Application Priority Data

Dec. 14, 2023 (TW) ..... 112148646

(51) Int. Cl.
*F41B 11/55* (2013.01)
*F41B 11/72* (2013.01)

(52) U.S. Cl.
CPC ..... *F41B 11/55* (2013.01); *F41B 11/72* (2013.01)

(58) Field of Classification Search
CPC ..... F41B 11/55; F41B 11/62; F41B 11/52; F41B 11/723; F41B 11/80; F41A 9/41; F41A 9/55
See application file for complete search history.

(56) References Cited

U.S. PATENT DOCUMENTS

| | | | | |
|---|---|---|---|---|
| 4,091,791 | A * | 5/1978 | Castelli | F41B 11/52 124/81 |
| 5,377,655 | A * | 1/1995 | Arad | F41B 11/55 124/66 |
| 8,826,792 | B1 * | 9/2014 | Granger | F41A 1/04 89/7 |
| 11,674,778 | B1 * | 6/2023 | Borter | F41A 9/41 124/73 |
| 12,044,509 | B1 * | 7/2024 | Borter | F41B 11/62 |
| 2006/0180134 | A1 * | 8/2006 | Illuzzi | F41A 9/24 102/502 |
| 2024/0077278 | A1 * | 3/2024 | Kung | F41B 11/89 |
| 2024/0328748 | A1 * | 10/2024 | Sweeting | F41B 11/89 |

* cited by examiner

*Primary Examiner* — Michael D David
(74) *Attorney, Agent, or Firm* — troutman pepper locke; Tim Tingkang Xia, Esq.

(57) ABSTRACT

A grenade device of a toy gun with an adjustable firing muzzle provided by the present invention comprises: a case, a pressure chamber, a projectile chamber, a switch valve, a launch tube, an outer cover, and a switch cover. The pressure chamber is in the case and receives a pressurized fluid. The projectile chamber is in the case and loaded plural projectile bodies in. The switch valve is between the pressure chamber and the pressure inlet, and is in a starting position to guide the pressurized fluid from the pressure chamber to the projectile chamber. The launch tube has a first and second end. The launch tube cooperates with the pressure chamber and the pressurized fluid to inject the projectile bodies. The outer cover is connected with the case, and has an opening. The switch cover has a through hole and is at a first or second position.

10 Claims, 11 Drawing Sheets

GRENADE DEVICE OF A TOY GUN WITH AN ADJUSTABLE FIRING MUZZLE AND AN ADJUSTING METHOD THEREOF

CROSS-REFERENCE TO RELATED APPLICATIONS

This application claims priority to Taiwan Application Serial Number 112148646, filed Dec. 14, 2023, which is herein incorporated by reference in its entirety.

BACKGROUND

Technical Field

The present invention is in related to a grenade device of a toy gun, more particular to a grenade device of a toy gun with an adjustable firing muzzle and an adjusting method thereof.

Related Art

For the past several years, adopting secure firearms in survival games has become increasingly popular, more particularly to entertainment, training, and other activities. In those survival games, the simulated weapons mainly consist of pneumatic toy guns, and the bullets are primarily of non-metallic spherical projectiles, or another name called BB pellets. Generally, such device is able to inject one or more projectile bodies or BB pellets. The estimates for the projectile bodies or BB pellets may create some funny feeling to human participants, but not hurts.

The factors for the precisions of the simulated weapons and the predictable operations are very important to achieve the success of a game/activity. For instance, a grenade device cannot inject the projectile bodies as participants' expect, or the arrangement of the injected projectile bodies is only one type, it will result in ineffective training or insufficient entertainment.

SUMMARY

The purpose of the present invention discloses a grenade device of a toy gun with an adjustable firing muzzle and an adjusting method thereof. Through changing a switch cover on different positions of a grenade device of a toy gun can achieve a function of arranging a plurality of projectile bodies in different statuses, wherein the plurality of projectile bodies are injected.

To achieve the above objective, the grenade device of the toy gun with the adjustable firing muzzle provided by the present invention comprises: a case, a pressure chamber, a projectile chamber, a switch valve, a launch tube, an outer cover, and a switch cover. The pressure chamber is located in the case, and receives a pressurized fluid. The projectile chamber is located in the case, and is loaded a plurality of projectile bodies in, and also has a pressure inlet and a pressure outlet. The switch valve is in between the pressure chamber and the pressure inlet, wherein the switch valve is located in a starting position, in order to guide the pressurized fluid from the pressure chamber to the projectile chamber. The launch tube has a first end and a second end. The first end is connected with the pressure outlet, wherein the launch tube cooperates with the pressure chamber and the pressurized fluid to inject the projectile bodies. The outer cover is connected with a side of the case, and has an opening, which is adjacent to the second end of the launch tube. The switch cover has a through hole and is located at a first position or a second position. The plurality of the projectile bodies projected by the launch tube are arranged into a first status if the switch cover is at the first position and the opening is close to the through hole; the plurality of the projectile bodies projected by the launch tube are arranged into a second status if the switch cover is at the second position and the opening is separated from the through hole.

As to a preferred embodiment of the present invention, the through hole is a hollow circular shape and has a first end surface and a second end surface, a cross-sectional area of the first end surface is smaller than a cross-sectional area of the second end surface. The dimensions of the first end surface correspond to the dimensions of the projectile body, and only the single projectile body can go through the first end surface. The dimensions of the second end surface are equal to the dimensions of the opening.

As to a preferred embodiment of the present invention, the outer cover has a guiding rail, which one end is neighbor to the opening, the switch cover slides on the guiding rail and is disposed on either the first position or the second position, the second end surface is close to the launch tube if the switch cover is on the first position.

As to a preferred embodiment of the present invention, the launch tube is through the opening and is elongated to the outside of the outer cover, and has an external thread structure, the switch cover has an internal thread structure, the switch cover is located at the first position and the second end surface is close to the launch tube when the switch cover is connected to the launch tube by rotation and locking.

As to a preferred embodiment of the present invention, the projectile chamber has a spiral shape and is located around the pressure chamber.

As to a preferred embodiment of the present invention, the first status is that a plurality of the projectile bodies are arranged in a scattering shape.

As to a preferred embodiment, the second status is that the plurality of projectiles are in a linear shape within a distance from the openings.

To achieve the above objective, the method for adjusting the firing muzzle of the grenade device of the toy gun comprises the steps of:

The step (a) is of: providing a pressurized fluid, a plurality of projectile bodies, a toy gun, and a plurality of grenade devices, wherein the grenade device has a case, a pressure chamber, a projectile chamber, an outer cover, and a switch cover, the pressure chamber and the projectile chamber being located in the case, the outer cover being connected with a side of the case;

The step (b) is of: the grenade device receiving the pressurized fluid via the pressure chamber, the projectile chamber being loaded the plurality of projectile bodies in;

The step (c) is of: the grenade device being connected with the toy gun;

The step (d) is of: locating the switch cover at a first position or a second position;

The step (e) is of: activating the grenade device, in order to inject the plurality of projectile bodies;

The step (f) is of: arranging the plurality of projectile bodies into a first status or a second status;

The step (g) is of: determining whether all the projectile bodies are injected; and The step (h) is of: changing the other grenade device if yes and repeating the step (c); otherwise, repeating the step (e).

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1A:
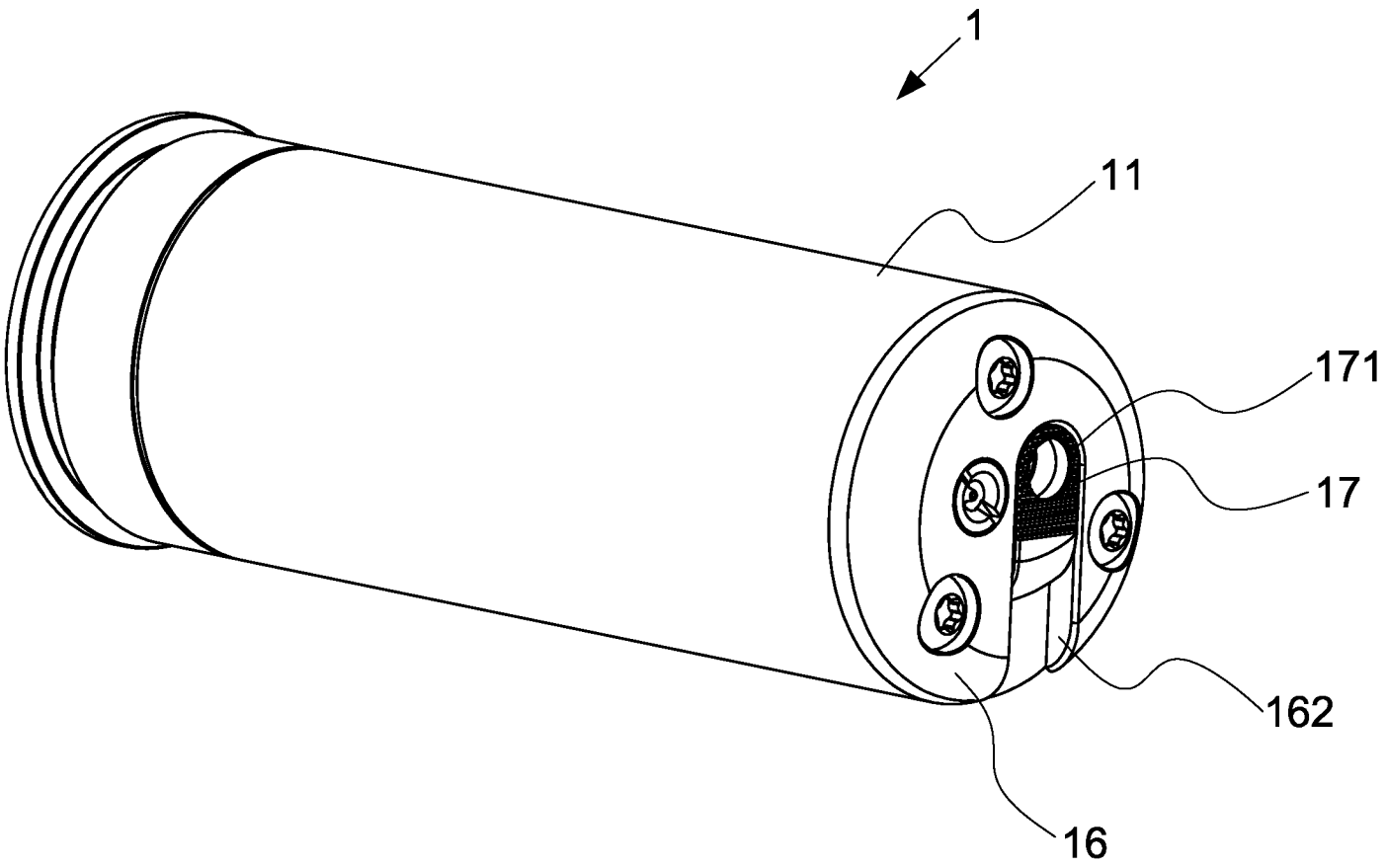
FIG. 1A illustrates a schematic 3-D view of a first preferred embodiment of the grenade device of the toy gun with the adjustable firing muzzle of the present invention.
Figure 1B:
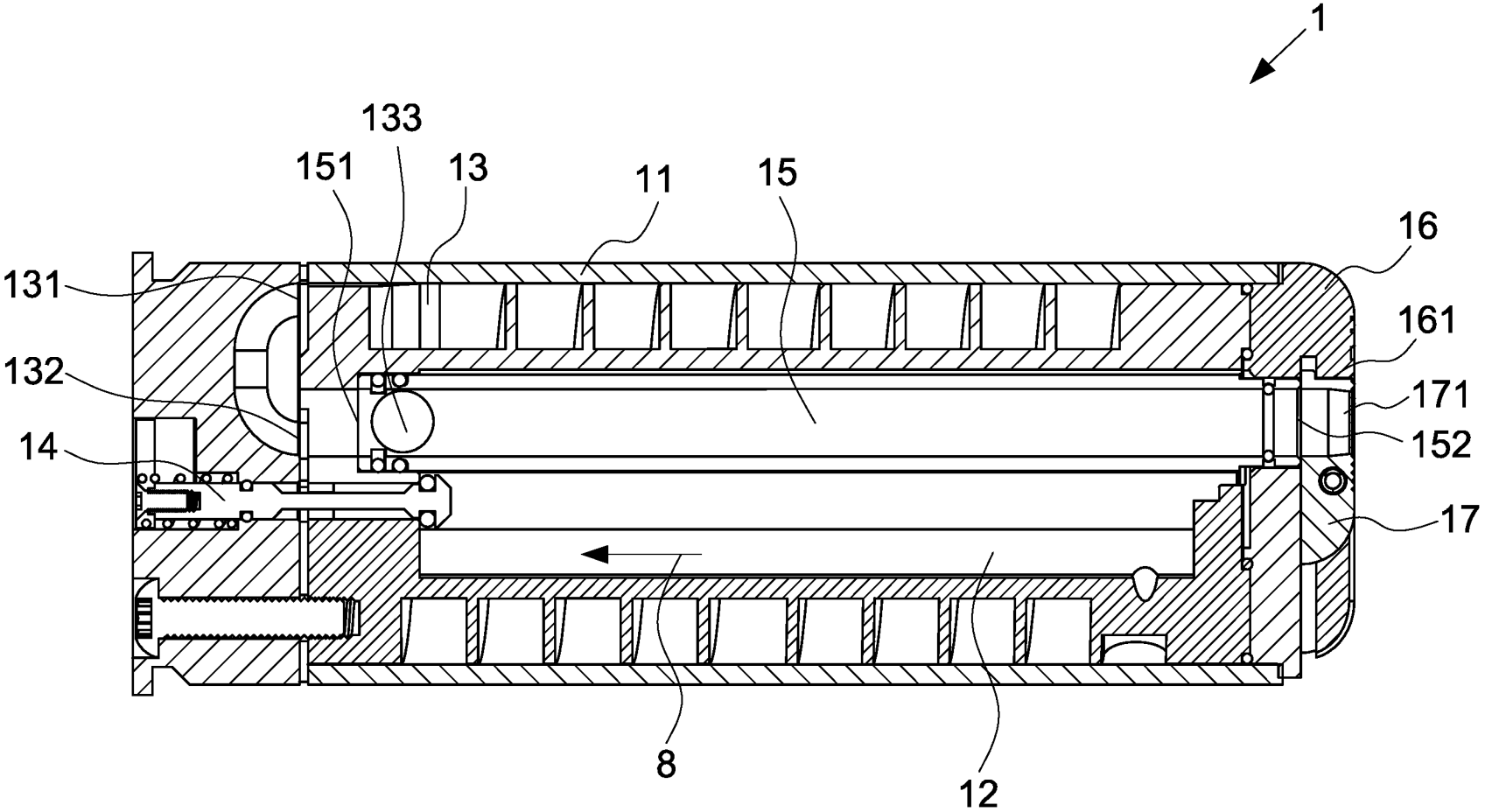
FIG. 1B illustrates a schematic cross-sectional view of the first preferred embodiment of the grenade device of the toy gun with the adjustable firing muzzle of the present invention.
Figure 2:
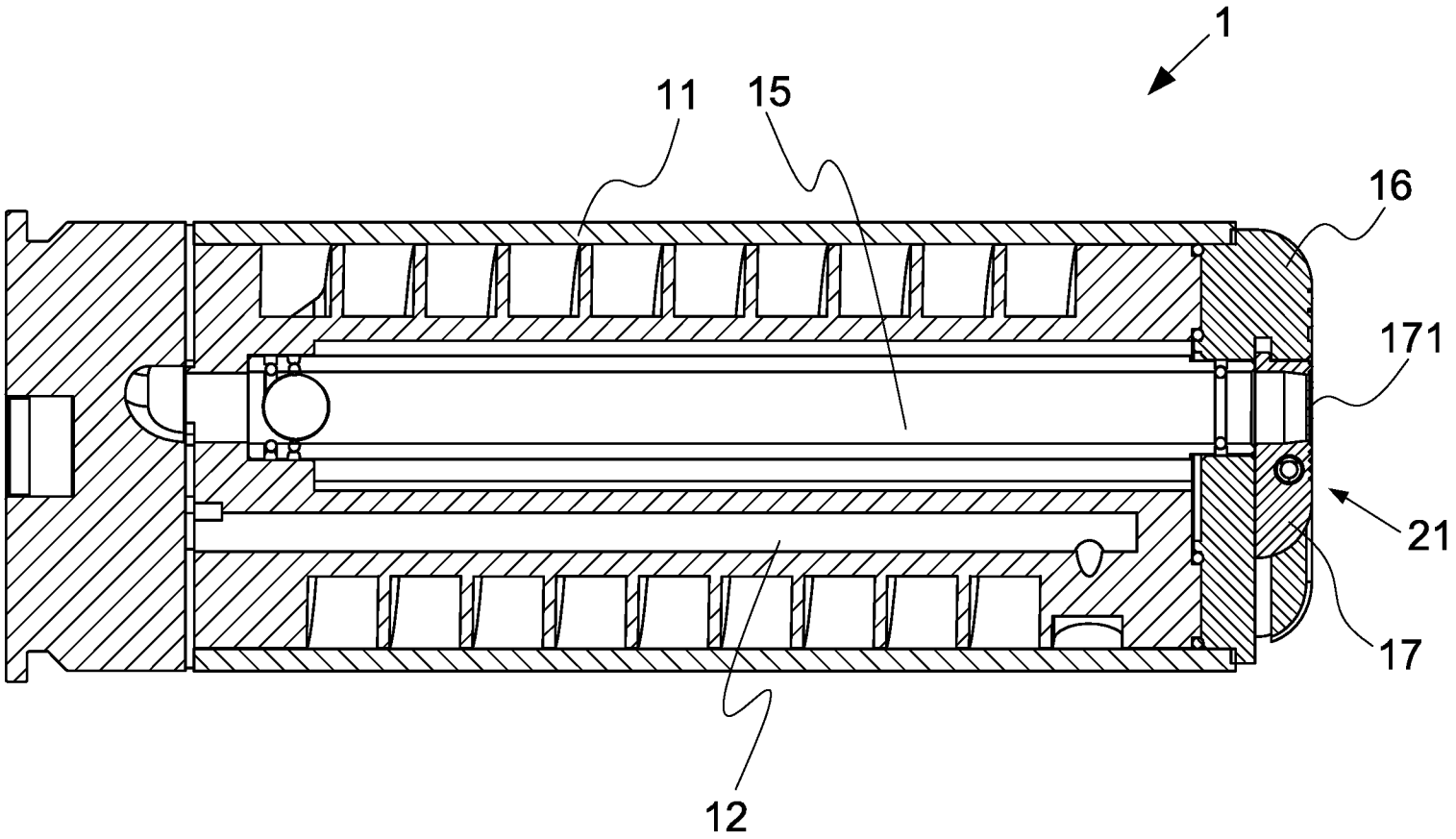
FIG. 2 illustrates a schematic cross-sectional view of a switch cover at a first position of the first preferred embodiment of the grenade device of the toy gun with the adjustable firing muzzle of the present invention.
Figure 3:
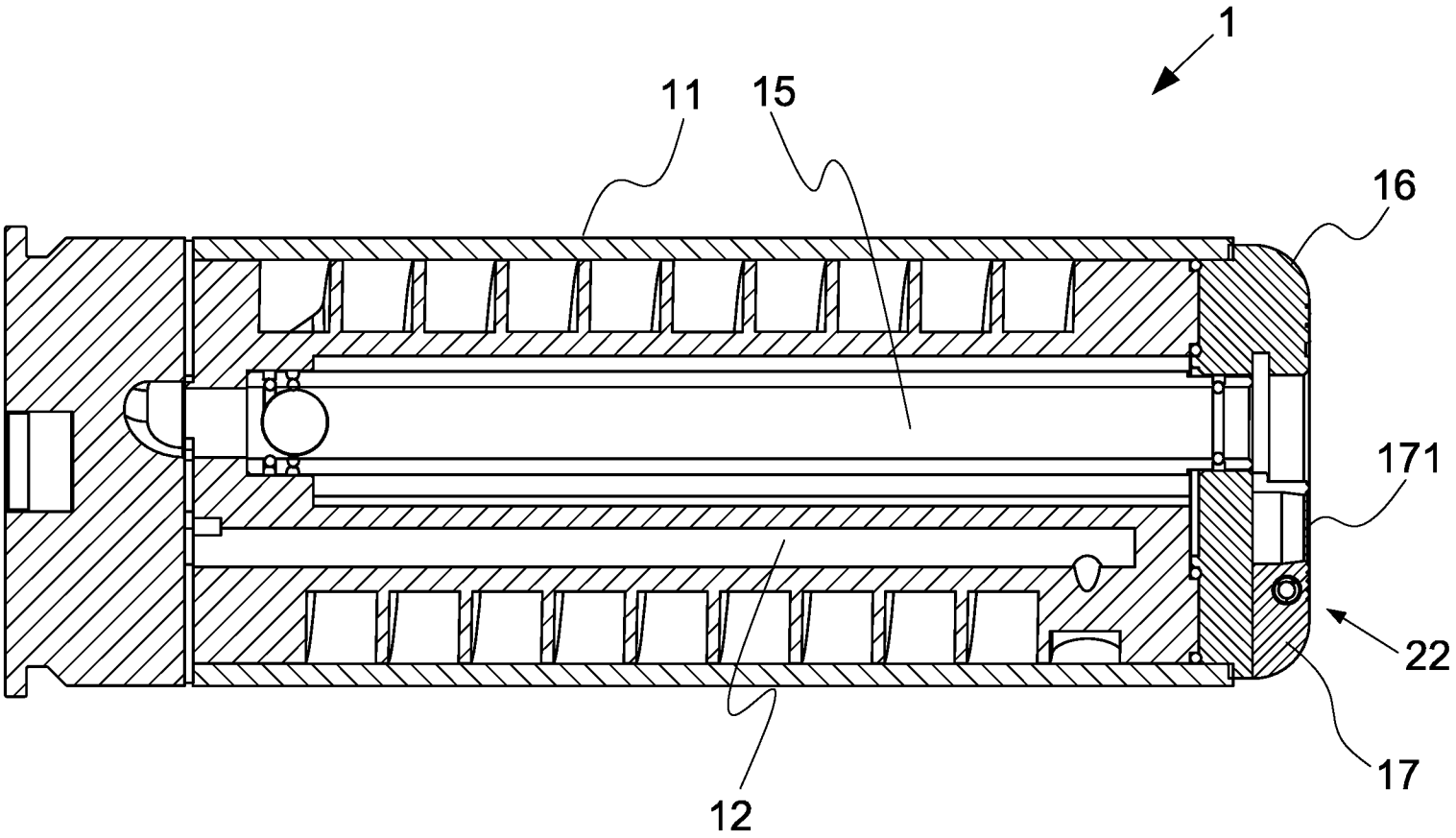
FIG. 3 illustrates a schematic cross-sectional view of the switch cover at a second position of the first preferred embodiment of the grenade device of the toy gun with the adjustable firing muzzle of the present invention.
Figure 4:
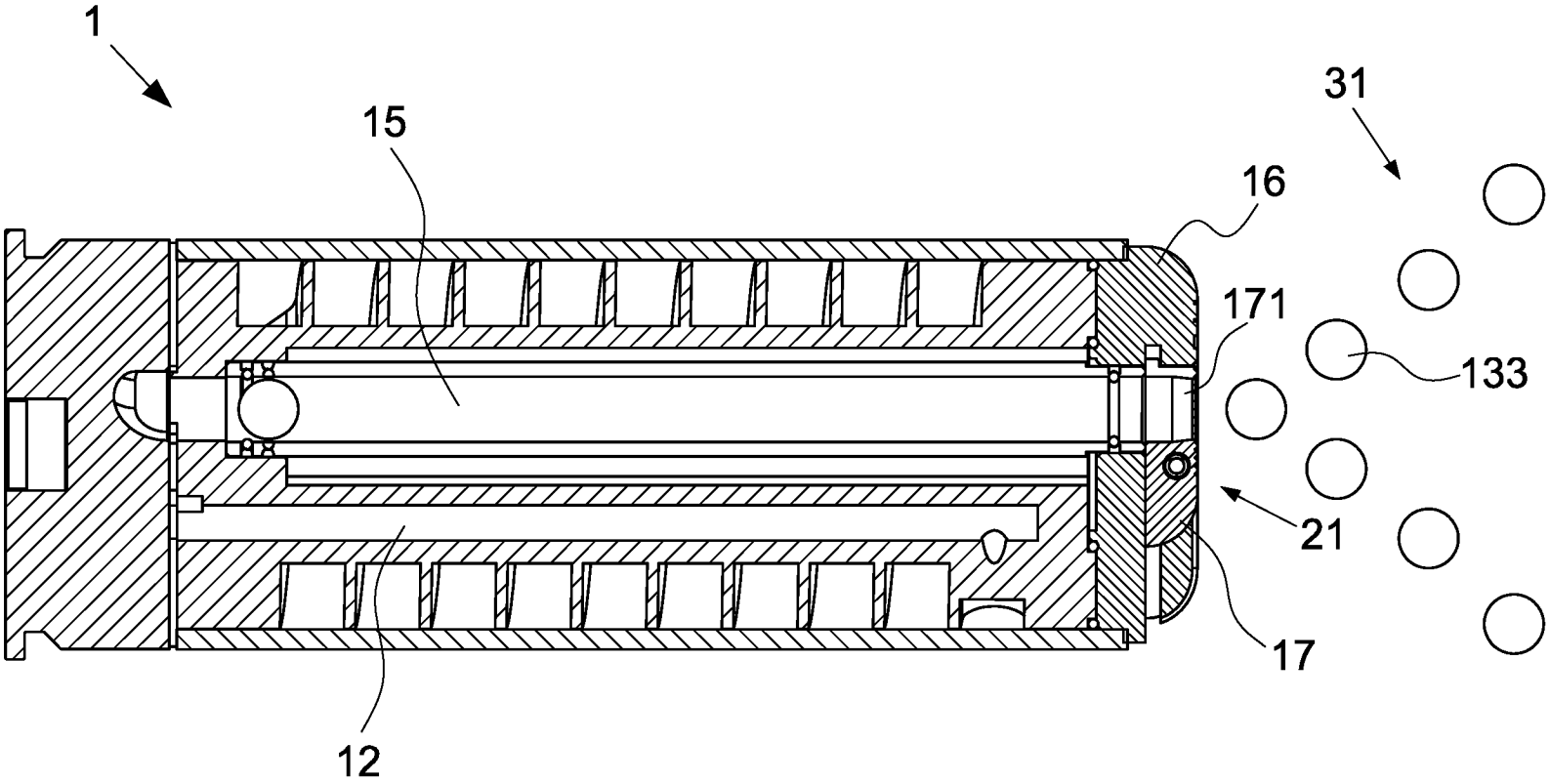
FIG. 4 illustrates a schematic cross-sectional view of a plurality of projectile bodies arranged into a first status of the first preferred embodiment of the grenade device of the toy gun with the adjustable firing muzzle of the present invention.
Figure 5:
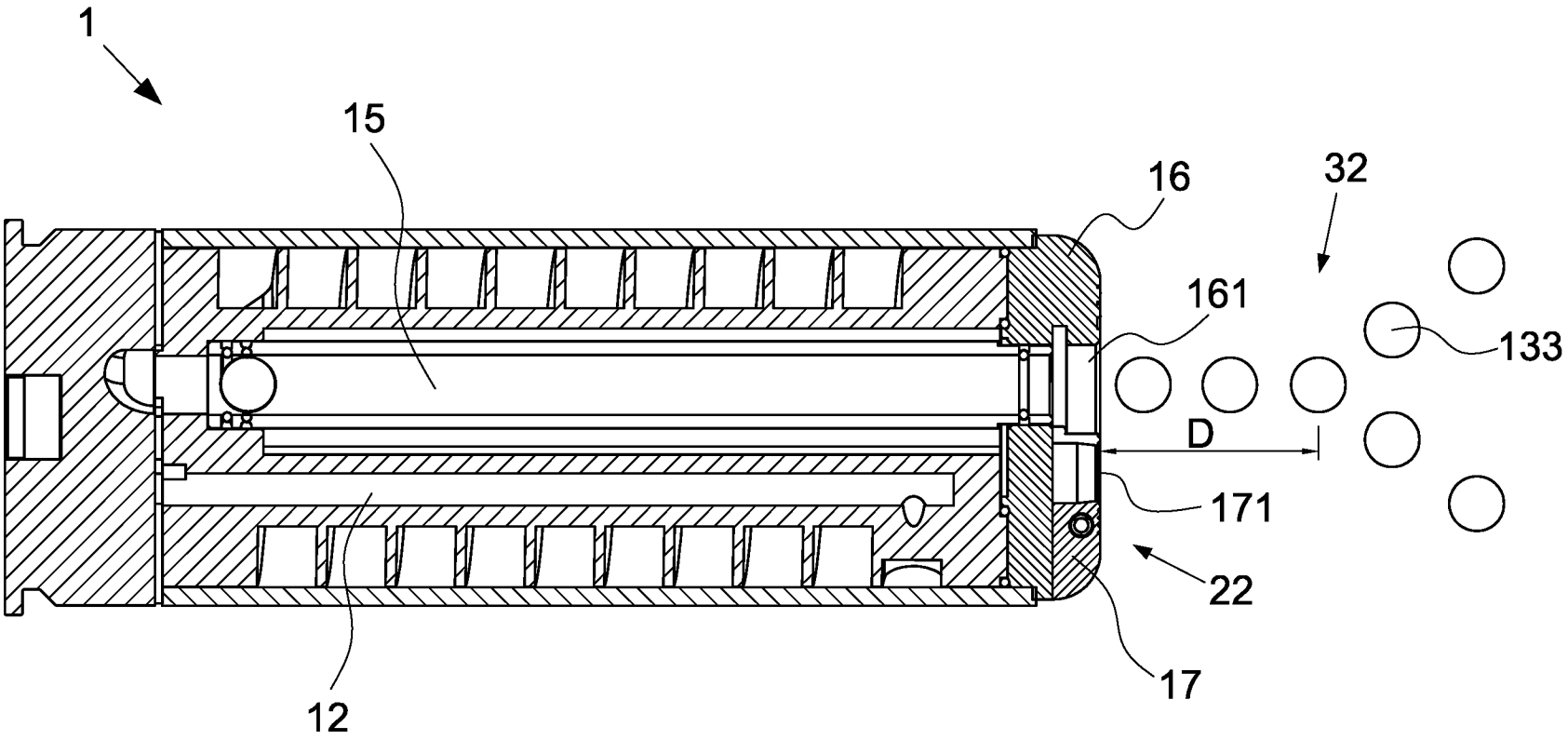
FIG. 5 illustrates a schematic cross-sectional view of the plurality of projectile bodies arranged into a second status of the first preferred embodiment of the grenade device of the toy gun with the adjustable firing muzzle of the present invention.
Figure 6A:
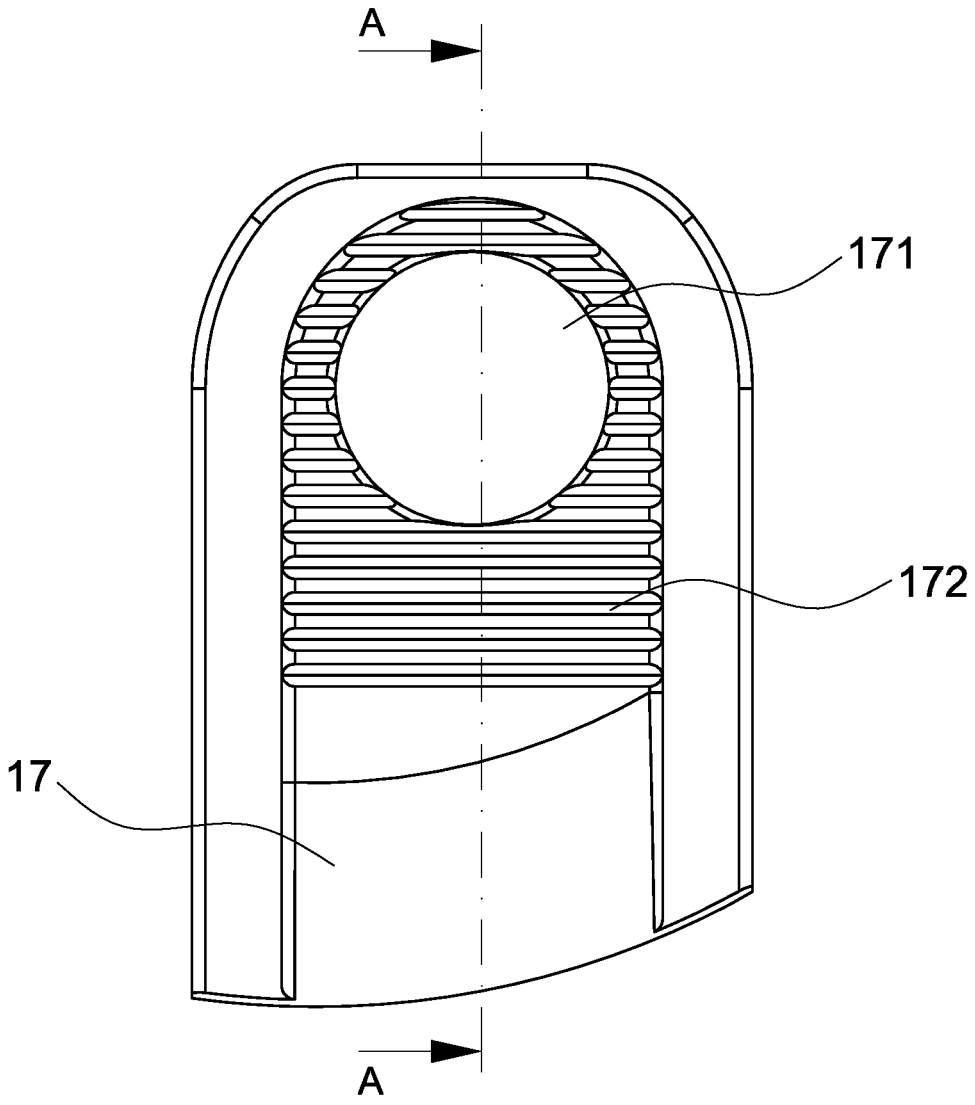
FIG. 6A illustrates a schematic structural front view of a preferred embodiment of the switch cover of the grenade device of the toy gun with the adjustable firing muzzle of the present invention.
Figure 6B:
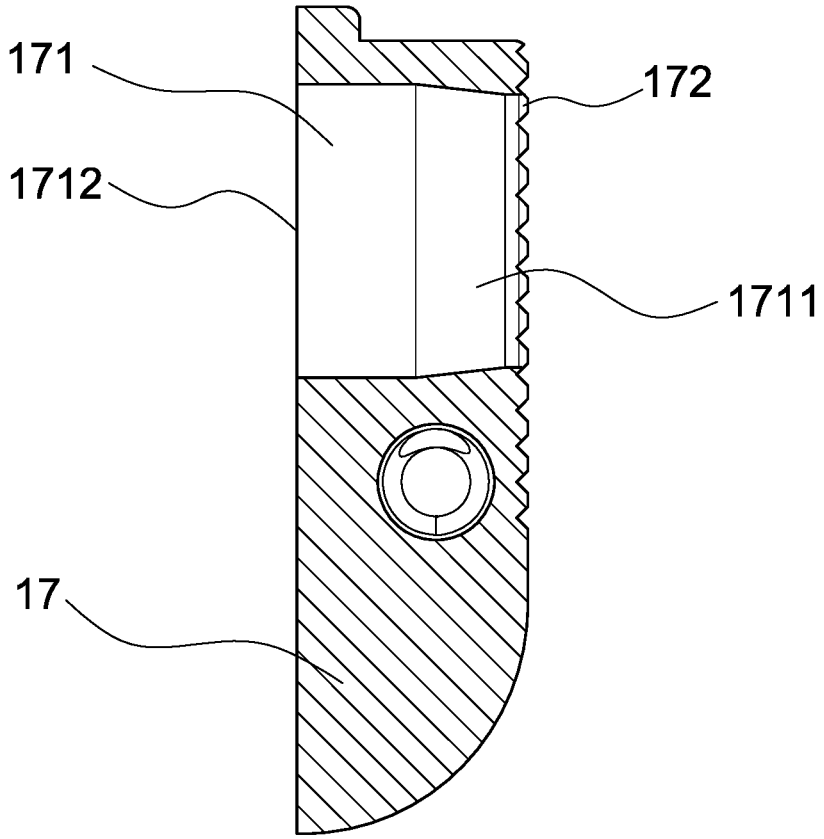
FIG. 6B illustrates a schematic A-A cross-sectional view of the preferred embodiment of the switch cover of the grenade device of the toy gun with the adjustable firing muzzle of the present invention.

Please refer to FIG. 1A to FIG. 6B, which illustrate a schematic 3-D view of a first preferred embodiment of the grenade device of the toy gun with the adjustable firing muzzle of the present invention, as shown in FIG. 1A, a schematic cross-sectional view of the first preferred embodiment of the grenade device of the toy gun with the adjustable firing muzzle of the present invention, as shown in FIG. 1B, a schematic cross-sectional view of a switch cover at a first position of the first preferred embodiment of the grenade device of the toy gun with the adjustable firing muzzle of the present invention, as shown in FIG. 2, a schematic cross-sectional view of the switch cover at a second position of the first preferred embodiment of the grenade device of the toy gun with the adjustable firing muzzle of the present invention, as shown in FIG. 3, a schematic cross-sectional view of a plurality of projectile bodies arranged into a first status of the first preferred embodiment of the grenade device of the toy gun with the adjustable firing muzzle of the present invention, as shown in FIG. 4, a schematic cross-sectional view of the plurality of projectile bodies arranged into a second status of the first preferred embodiment of the grenade device of the toy gun with the adjustable firing muzzle of the present invention, as shown in FIG. 5, a schematic structural front view of a preferred embodiment of the switch cover of the grenade device of the toy gun with the adjustable firing muzzle of the present invention, as shown in FIG. 6A, and a schematic A-A cross-sectional view of the preferred embodiment of the switch cover of the grenade device of the toy gun with the adjustable firing muzzle of the present invention, as shown in FIG. 6B.

A grenade device of a toy gun with an adjustable firing muzzle provided by the present invention comprises: a case 11, a pressure chamber 12, a projectile chamber 13, a switch valve 14, a launch tube 15, an outer cover 16, and a switch cover 17. The pressure chamber 2 is located in the case 11, and receives a pressurized fluid. The projectile chamber 13 is located in the case 11, and is loaded a plurality of projectile bodies 133 in, and also has a pressure inlet 131 and a pressure outlet 132. For a preferred embodiment, the projectile chamber 13 has a spiral shape and is located around the pressure chamber 12.

The switch valve 14 is in between the pressure chamber 12 and the pressure inlet 131, wherein the switch valve 14 is located in a starting position, in order to guide the pressurized fluid 8 from the pressure chamber 12 to the projectile chamber 13. The launch tube 15 has a first end 151 and a second end 152. The first end 151 is connected with the pressure outlet 132, wherein the launch tube 15 cooperates with the pressure chamber 12 and the pressurized fluid 8 to inject the projectile bodies 133.

The outer cover 16 is connected with a side of the case 11, and has an opening 161, which is adjacent to the second end 152 of the launch tube 15. The switch cover 17 has a through hole 171 and is located at a first position 21 or a second position 22. The through hole 171 is a hollow circular shape and has a first end surface 1711 and a second end surface 1712. The cross-sectional area of the first end surface 1711 is smaller than the cross-sectional area of the second end surface 1712. The dimensions of the first end surface 1711 correspond to the dimensions of the projectile body 133, and only the single projectile body 133 can go through the first end surface 1711. The dimensions of the second end surface 1712 are equal to the dimensions of the opening 161. To a preferred embodiment, the outer cover 16 has a guiding rail 162, which one end is neighbor to the opening 161. The switch cover 17 slides on the guiding rail 162 and is disposed on either the first position 21 or the second position 22. The second end surface 1712 is close to the launch tube 15 if the switch cover 17 is on the first position 21.

Accordingly, the plurality of the projectile bodies 133 projected by the launch tube 15 are arranged into a first status 31 if the switch cover 17 is at the first position 21 and the opening 161 is close to the through hole 171, wherein the first status 31 is that the plurality of the projectile bodies (133) are arranged in a scattering shape. The plurality of the projectile bodies 133 projected by the launch tube 15 are arranged into a second status 32 if the switch cover 17 is at the second position 22 and the opening 161 is separated from the through hole 171, wherein the second status is that the plurality of projectiles 133 are in a linear shape within a distance from the openings 161.

Figure 7A:
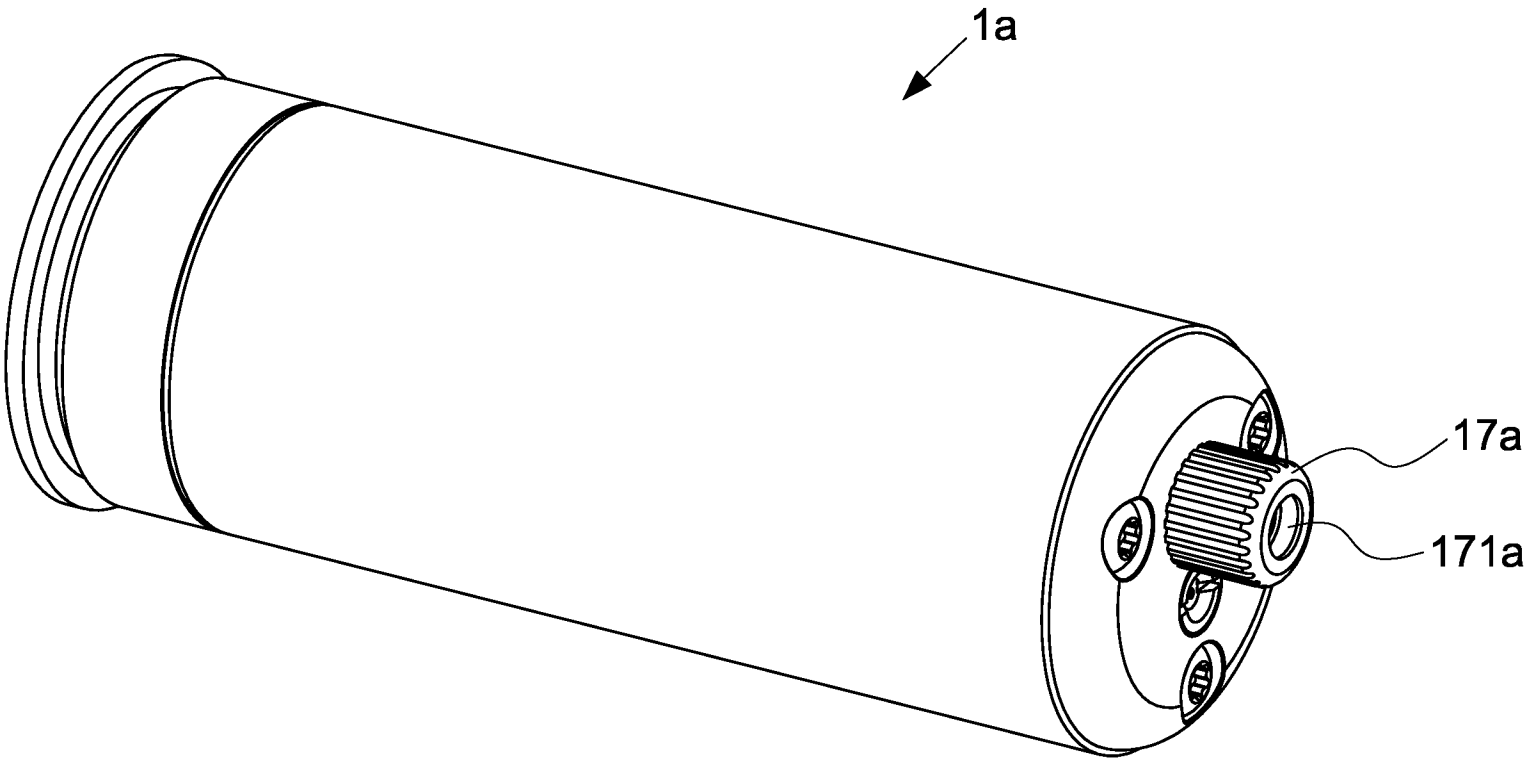
FIG. 7A illustrates a schematic 3-D view of a second preferred embodiment of the grenade device of the toy gun with the adjustable firing muzzle of the present invention.
Figure 7B:
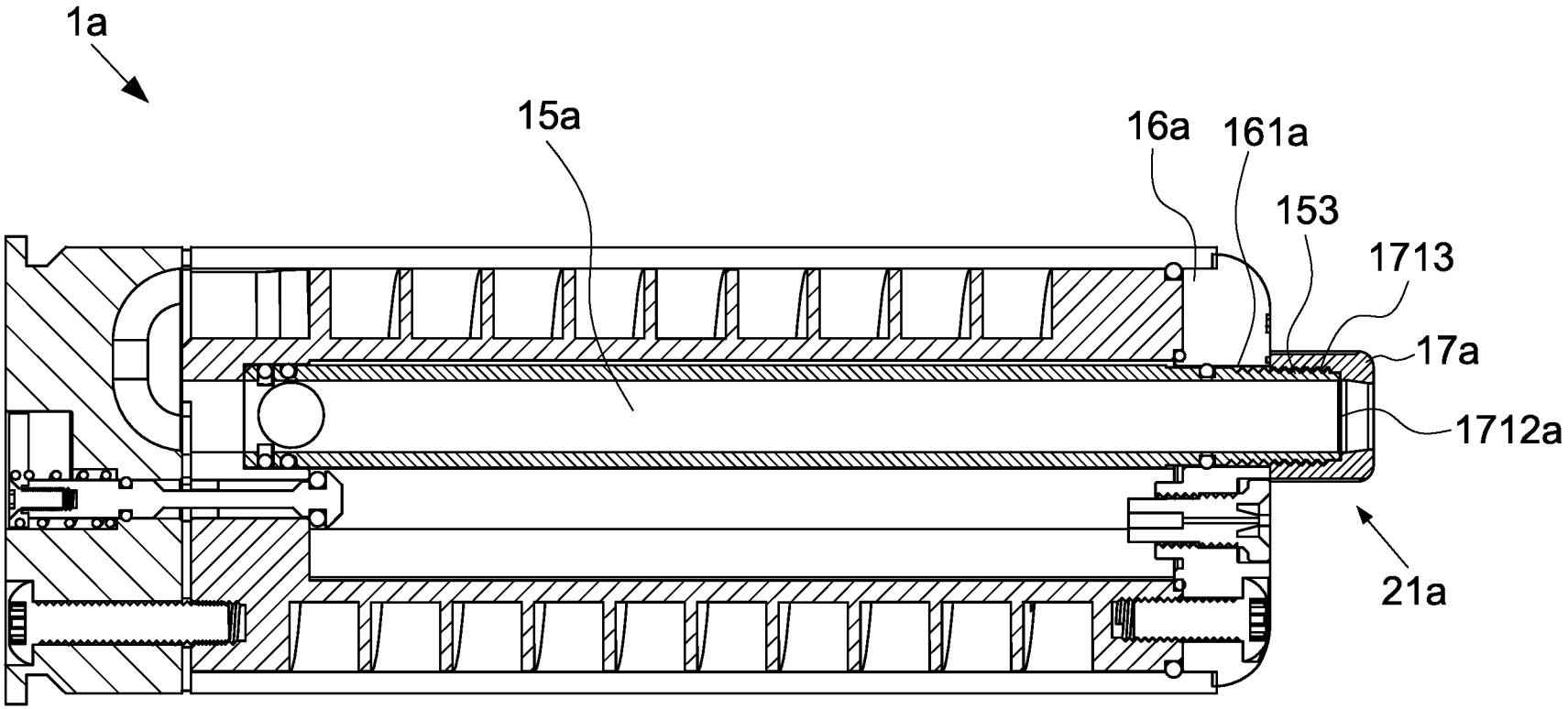
FIG. 7B illustrates a schematic cross-sectional view of the second preferred embodiment of the grenade device of the toy gun with the adjustable firing muzzle of the present invention.

With reference to FIG. 7A and FIG. 7B, which illustrate a schematic 3-D view of a second preferred embodiment of the grenade device of the toy gun with the adjustable firing muzzle of the present invention and a schematic cross-sectional view of the second preferred embodiment of the grenade device of the toy gun with the adjustable firing muzzle of the present invention. Accordingly, the launch tube 15*a* is through the opening 161*a* and is elongated to the outside of the outer cover 16*a*, and has an external thread structure 153. The switch cover 17*a* has an internal thread structure 1713, and the switch cover 17*a* is located at the first position 21*a* and the second end surface 1712*a* is close to the launch tube 15*a* when the switch cover 17*a* is connected to the launch tube 15*a* by rotation and locking.

Figure 8:
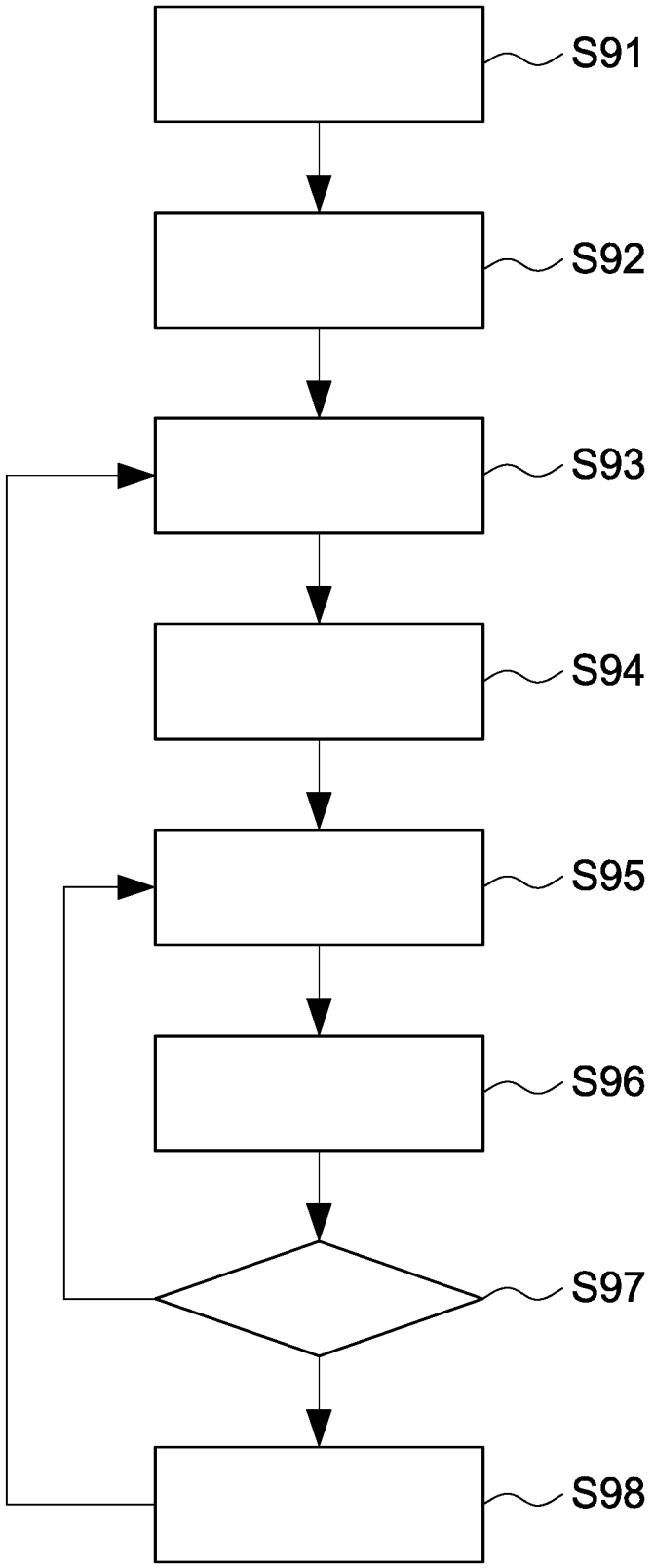
FIG. 8 illustrates a flow chart of a preferred embodiment of the method for adjusting the firing muzzle of the grenade device of the toy gun of the present invention.

Regarding to FIG. 8, which illustrates a flow chart of a preferred embodiment of the method for adjusting the firing muzzle of the grenade device of the toy gun of the present invention. Continuously, the method for adjusting the firing muzzle of the grenade device of the toy gun includes the steps listed below.

The step (S91) is of: providing a pressurized fluid, the plurality of projectile bodies 133, a toy gun, and the plurality of grenade devices 1, wherein the grenade device 1 has the case 11, the pressure chamber 12, the projectile chamber 13, the outer cover 16/16*a*, and the switch cover 17/17*a*, the pressure chamber 12 and the projectile chamber 13 being located in the case 11, the outer cover 16/16*a* being connected with the side of the case 11;

The step (S92) is of: the grenade device 1 receiving the pressurized fluid via the pressure chamber 12, the projectile chamber 13 being loaded the plurality of projectile bodies (133) in;

The step (S93) is of: the grenade device 1 being connected with the toy gun;

The step (S94) is of: locating the switch cover 17/17*a* at a first position 21/21*a* or a second position 22;

The step (S95) is of: activating the grenade device 1, in order to inject the plurality of projectile bodies 133;

The step (S96) is of: arranging the plurality of projectile bodies 133 into a first status 31 or a second status 32;

The step (S97) is of: determining whether all the projectile bodies 133 are injected; and The step (S98) is of: changing the other grenade device 1 if yes and repeating the step (S93); otherwise, repeating the step (S95).

Although the present disclosure is disclosed in the foregoing embodiments, it is not intended to limit the present disclosure. Changes and modifications made without departing from the spirit and scope of the present disclosure belong to the scope of the claims of the present disclosure. The scope of protection of the present disclosure should be construed based on the following claims.

What is claimed is:

1. A grenade device of a toy gun with an adjustable firing muzzle comprising:

a case (11);

a pressure chamber (12), located in the case (11) and receiving a pressurized fluid (8);

a projectile chamber (13), located in the case (11), loaded a plurality of projectile bodies (133) in, and having a pressure inlet (131) and a pressure outlet (132);

a switch valve (14), located in between the pressure chamber (12) and the pressure inlet (131), wherein the switch valve (14) is located in a staring position, in order to guide the pressurized fluid (8) from the pressure chamber (12) to the projectile chamber (13);

a launch tube (15/15*a*), having a first end (151) and a second end (152), the first end (151) being connected with the pressure outlet (132), wherein the launch tube (15/15*a*) cooperates with the pressure chamber (12) and the pressurized fluid 8 to inject the projectile bodies (133);

an outer cover (16/16*a*), being connected with a side of the case (11), having an opening (161/161*a*), which is adjacent to the second end (152) of the launch tube (15/15*a*); and a switch cover (17/17*a*), having a through hole (171) and located at a first position (21/21*a*) or a second position (22);

wherein the plurality of the projectile bodies (133) projected by the launch tube (15/15*a*) are arranged into a first status (31) if the switch cover (17/17*a*) is at the first position (21) and the opening (161/161*a*) is close to the through hole (171), and the plurality of the projectile bodies (133) projected by the launch tube (15/15*a*) are arranged into a second status (32) if the switch cover (17/17*a*) is at the second position (22) and the opening (161/161*a*) is separated from the through hole (171).

2. The grenade device of the toy gun with the adjustable firing muzzle according to claim 1, wherein the through hole (171) is a hollow circular shape and has a first end surface (1711) and a second end surface (1712/1712*a*), a cross-sectional area of the first end surface (1711) being smaller than a cross-sectional area of the second end surface (1712/1712*a*).

3. The grenade device of the toy gun with the adjustable firing muzzle according to claim 2, wherein dimensions of the first end surface (1711) correspond to dimensions of the projectile body (133), and only the single projectile body (133) can go through the first end surface (1711).

4. The grenade device of the toy gun with the adjustable firing muzzle according to claim 2, wherein dimensions of the second end surface (1712/1712*a*) are equal to dimensions of the opening (161/161*a*).

5. The grenade device of toy gun with the adjustable firing muzzle according to claim 2, wherein the outer cover (16/16*a*) has a guiding rail (162), which one end is neighbor to the opening (161), the switch cover (17/17*a*) sliding on the guiding rail (162) and being disposed on either the first position (21) or the second position (22), the second end surface (1712/1712*a*) being close to the launch tube (15/15*a*) if the switch cover (17/17*a*) is on the first position (21).

6. The grenade device of the toy gun with the adjustable firing muzzle according to claim 2, wherein the launch tube (15/15*a*) is through the opening (161/161*a*) and is elongated to an outside of the outer cover (16/16*a*), and has an external thread structure (153), the switch cover (17/17*a*) having an internal thread structure (1713), the switch cover (17/17*a*) being located at the first position (21) a and the second end surface (1712/1712*a*) being close to the launch tube (15/15*a*) when the switch cover (17/17*a*) is connected to the launch tube (15/15*a*) by rotation and locking.

7. The grenade device of the toy gun with the adjustable firing muzzle according to claim 1, wherein the projectile chamber (13) has a spiral shape and is located around the pressure chamber (12).

8. The grenade device of the toy gun with the adjustable firing muzzle according to claim 1, wherein the first status (31) is that a plurality of the projectile bodies (133) are arranged in a scattering shape.

9. The grenade device of the toy gun with the adjustable firing muzzle according to claim 1, wherein the second status is that the plurality of projectiles (133) are in a linear shape within a distance from the openings (161/161*a*).

10. A method for adjusting a firing muzzle of a grenade device of a toy gun, comprising the steps of:

(a) providing a pressurized fluid, a plurality of projectile bodies (133), a toy gun, and a plurality of grenade devices (1), wherein the grenade device (1) has a case (11), a pressure chamber (12), a projectile chamber (13), an outer cover (16/16*a*), and a switch cover (17/17*a*), the pressure chamber (12) and the projectile chamber (13) being located in the case (11), the outer cover (16/16*a*) being connected with a side of the case (11);

(b) the grenade device (1) receiving the pressurized fluid via the pressure chamber (12), the projectile chamber (13) being loaded the plurality of projectile bodies (133) in;

(c) the grenade device (1) being connected with the toy gun;

(d) locating the switch cover (17/17*a*) at a first position (21/21*a*) or a second position (22);

(e) activating the grenade device (1), in order to inject the plurality of projectile bodies (133);

(f) arranging the plurality of projectile bodies (133) into a first status (31) or a second status (32);

(g) determining whether all the projectile bodies (133) are injected; and (h) changing the other grenade device (1) if yes and repeating the step (c); otherwise, repeating the step (e).

* * * * *